US007473070B2

(12) United States Patent
Song et al.

(10) Patent No.: US 7,473,070 B2
(45) Date of Patent: Jan. 6, 2009

(54) BLOWER AND DESIGN METHOD OF DISCHARGE PORT THEREOF

(75) Inventors: Sung Bae Song, Gyeonggi-Do (KR); Sang Bum Sohn, Seoul (KR); Je Jun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 468 days.

(21) Appl. No.: 11/253,746

(22) Filed: Oct. 20, 2005

(65) Prior Publication Data

US 2006/0086734 A1 Apr. 27, 2006

(30) Foreign Application Priority Data

Oct. 22, 2004 (KR) ..... 10-2004-0084995

(51) Int. Cl.
*H05B 6/64* (2006.01)

(52) U.S. Cl. ..... 415/119; 415/206

(58) Field of Classification Search ..... 415/119, 415/203, 204, 206, 213.1, 214.1, 211.2, 211.1, 415/212.1

See application file for complete search history.

(56) References Cited

U.S. PATENT DOCUMENTS 6,200,093 B1 * 3/2001 Lee et al. ..... 415/204
6,677,564 B1 * 1/2004 Sohn et al. ..... 415/204
6,953,319 B2 * 10/2005 Sohn et al. ..... 415/119

FOREIGN PATENT DOCUMENTS

| | | | |
|---|---|---|---|
| CN | 1470768 | A | 1/2004 |
| JP | 54-99105 | U | 7/1979 |
| JP | 2002-54599 | A | 2/2002 |
| KR | 2000-0040209 | A | 7/2000 |

* cited by examiner

*Primary Examiner*—Igor Kershteyn
(74) *Attorney, Agent, or Firm*—Birch, Stewart, Kolasch & Birch, LLP

(57) ABSTRACT

A blower comprising: a centrifugal fan; a driving unit for rotating the centrifugal fan; a bracket including a base fixedly-coupled to one side of the driving unit and a protrusion protruded from the base in a shaft direction of the centrifugal fan; and a fan housing fixedly-coupled to the bracket so as to rotatably receive the centrifugal fan, and including a suction port formed at one side of the bracket in the shaft direction of the centrifugal fan so as to suck air by the rotation of the centrifugal fan, and a discharge port formed in a perpendicular direction of the suction port, for discharging the air sucked through the suction port, wherein one side of the discharge port is formed in 'V' shape by a first inclination surface formed in the protrusion of the bracket and a second inclination surface formed at the fan housing which is contact with one end of the protrusion, and at least one of the first and second inclination surfaces is formed in a curved line so as to increase a discharge area of the discharge port, whereby a flow rate discharged through the discharge port can uniformly be distributed so as to reduce noise and simultaneously increase a discharged air volume.

12 Claims, 5 Drawing Sheets

BLOWER AND DESIGN METHOD OF DISCHARGE PORT THEREOF

BACKGROUND OF THE INVENTION

1. Field of the Invention

The present invention relates to a blower, and particularly, to a blower used in an over-the-range (OTR) microwave oven and the like and a design method of a discharge port thereof.

2. Description of the Conventional Art

In general, an OTR microwave oven is one of electric home appliances, which is installed on a wall surface of an upper space portion of a gas range which is installed in the kitchen, so as to be used for cooking using microwave in a cavity and for sucking/exhausting combustion gas and pollution air in the kitchen (i.e., performing a ventilation function) generated from the gas range installed under the OTR microwave oven using a blower installed therein.

FIG. 1 shows a typical type of the conventional OTR microwave oven, which will now briefly be explained as follows.

The conventional OTR microwave oven, as shown in FIG. 1, includes a main body 1 having a cavity (i.e., a cooking space) C for cooking by a microwave, an outer casing 3 receiving the main body 1 and having an exhaust passage 2 at both sides of the main body 1, and a blower 4 installed at a upper rear side of the main body 1.

A rotary tray 5 is rotatably installed inside the cavity C so as to rotate food taken in the cavity C. A magnetron 8 for generating microwave induced inwardly to the cavity C while cooking is installed at an outer side of the cavity C.

An air suction port 6 communicated with the exhaust passage 2 is positioned at a lower side of the outer casing 3, and an air discharge port 7 for discharging air to the exterior is formed on an upper surface of the outer casing 3. Here, according to a user's convenience, the air discharge port 7 may be connected to a ventilating duct of a building, and the like, through a connection duct (not shown), or be installed on the entire upper surface of the outer casing 3.

Such constructed conventional OTR microwave oven is installed above a gas range, and serves as a hood for ventilating smoke or smell generated when a user cooks using the gas range as well as performing the original function of the microwave oven.

The user opens a door (not shown) and puts food on a rotary tray 5 in the cavity C. The user then closes the door and presses an operating button of an adjustment plate (not shown). According to the this, the rotary tray 5 is rotated, which rotates the food thereon and simultaneously generates microwave from a magnetron 10. The microwave generated is induced inside the cavity C to cook food thereby, all of which is the original function of the microwave oven performed by the conventional OTR microwave oven.

Furthermore, in the conventional OTR microwave oven, when the user presses the hood operation button of the adjustment plate, the blower 4 installed in the microwave oven is driven so as to generate a suction force, by which combustion gas and pollution air generated when the user cooks using the gas range installed under the microwave oven, as indicated by a biased line in FIG. 1, are sucked through the air suction port 6 formed at a lower surface of the outer casing 3. The sucked air is discharged to the exterior through the air discharge port 7 formed at an upper surface of the outer casing 3, whereby the conventional OTR microwave oven serves as the hood for ventilating smoke or smell.

The blower 4 of the conventional OTR microwave oven, on the other hand, as shown in FIGS. 2 and 3, includes a bracket 22 respectively coupled to both sides of a motor 21 positioned in the center, a centrifugal fan 23 coupled to a rotary shaft (not shown) protruded outwardly from the center portion of each bracket 22, and a cylindrical fan housing 24 of which one side is fixed to the bracket 22 and covering the outside of the centrifugal fan 23.

The fan housing 24 is provided with a suction port 25 for sucking external air, and a discharge port 26 formed in a perpendicular direction of the suction port 25, for discharging air sucked through the suction port 25.

A cut-off portion 17 for guiding discharged air is protrudingly-formed at one side of the discharge port 26.

In the conventional blower 4 which has the configuration as aforementioned, when power is applied, the motor 21 is rotated and thus the centrifugal fan 23 axially coupled to the motor 21 is rotated as well. The suction force is generated by the rotation of the centrifugal fan 23 to suck external air inwardly through the suction port 25 formed at one side of each fan housing 24.

The air sucked into the fan housing 24 through the suction port 25 is discharged through the discharge port 26 formed in the perpendicular direction of the suction port 25 by the rotation force of the centrifugal fan 23.

However, in the conventional blower 4, an air flow formed by the rotation of the centrifugal fan 23 forms a large loss area due to growth of a boundary layer at an edge portion of the discharge port 26. The air flow loss in the discharge port 26 may impede air volume and also increase noise.

A scheme for forming the cut-off portion of the discharge port 26 in 'V'-shape has been proposed as a way to solve the problem which has been applied by this assignee and disclosed in U.S. Pat. No. 6,200,093.

However, in the type of forming the discharge port in the 'V'-shape as proposed by this assignee, a flow rate discharge through the discharge port has uniformly been distributed to thus reduce noise to some degree, but a discharged air volume has unfortunately been reduced.

SUMMARY OF THE INVENTION

Therefore, to solve the problems, an object of the present invention is to provide a blower capable of reducing noise and increasing a discharged air volume by uniformly distributing a flow rate discharged through a discharge port, and a design method for the discharge port thereof.

To achieve these and other advantages and in accordance with the purpose of the present invention, as embodied and broadly described herein, there is provided a blower comprising: a centrifugal fan; a driving unit for rotating the centrifugal fan; a bracket including a base fixedly-coupled to one side of the driving unit, and a protrusion protruded from the base in a shaft direction of the centrifugal fan; and a fan housing fixedly-coupled to the bracket to rotatably receive the centrifugal fan, and including a suction port formed at one side of the bracket in the shaft direction of the centrifugal fan so as to suck air by the rotation of the centrifugal fan, and a discharge port formed in a perpendicular direction of the suction port, for discharging the air sucked through the suction port, wherein one side of the discharge port is formed in 'V' shape by a first inclination surface formed in the protrusion of the bracket and a second inclination surface formed at the fan housing which is contact with one end of the protrusion, and at least one of the first and second inclination surfaces is formed in a curved line so as to increase a discharge area of the discharge port.

According to another embodiment of the present invention, a blower comprises: a pair of centrifugal fans; a driving unit for rotating the centrifugal fans; a pair of brackets each of which includes a base fixedly-coupled to both sides of the driving unit, respectively, and a protrusion protruded from the base in a shaft direction of the centrifugal fan; and a pair of fan housings fixedly-coupled to the bracket, respectively, so as to rotatably receive the centrifugal fan, and each of which includes a suction port formed at one side of the bracket in the shaft direction of the centrifugal fan so as to suck air by the rotation of the centrifugal fan, and a discharge port formed in a perpendicular direction of the suction port, for discharging the air sucked through the suction port, wherein one side of the discharge port is formed in 'V' shape by a first inclination surface formed in the protrusion of the bracket and a second inclination surface formed at the fan housing which is contact with one end of the protrusion, and at least one of the first and second inclination surfaces is formed in a curved line so as to increase a discharge area of the discharge port.

To achieve these and other advantages and in accordance with the purpose of the present invention, as embodied and broadly described herein, there is provided a method for designing a curved line of a first inclination surface configuring a discharge port of a blower comprising the steps of: drawing a first circle having a radius corresponding to a distance between a first end point and a second end point positioned on the same plane, among points where a first inclination surface meets a base of a bracket centered upon the first end point of a tangential line of one end 427 of a protrusion of the bracket which is contact with one end of the fan housing having a second inclination surface; drawing a second circle having a radius corresponding to a distance between the first end point and the second end point centering around the second end point; obtaining a first intersection point where a straight line passing through two intersection points of the first and second circles meets one of straight lines which pass through the first end point and are perpendicular to the rotary shaft of the centrifugal fan; and drawing a third circle having a radius corresponding to a distance between the first intersection point and the first end point centered upon the first intersection point and thus obtaining a curved line passing through the first and second end points.

The foregoing and other objects, features, aspects and advantages of the blower and the design method for the discharge port thereof according to the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A plurality of embodiments for a blower according to present invention may exist. Hereinafter, the preferred embodiment thereof will be explained. The blower according to the present invention, on the other side, is driven similar to the conventional blower, and thus an explanation of a driving of a blowing device will be omitted.

In addition, the spirit and scope of the present invention are not limited on particular embodiments as follows, but variable within its spirit and scope as defined in the appended claims.

Figure 1:
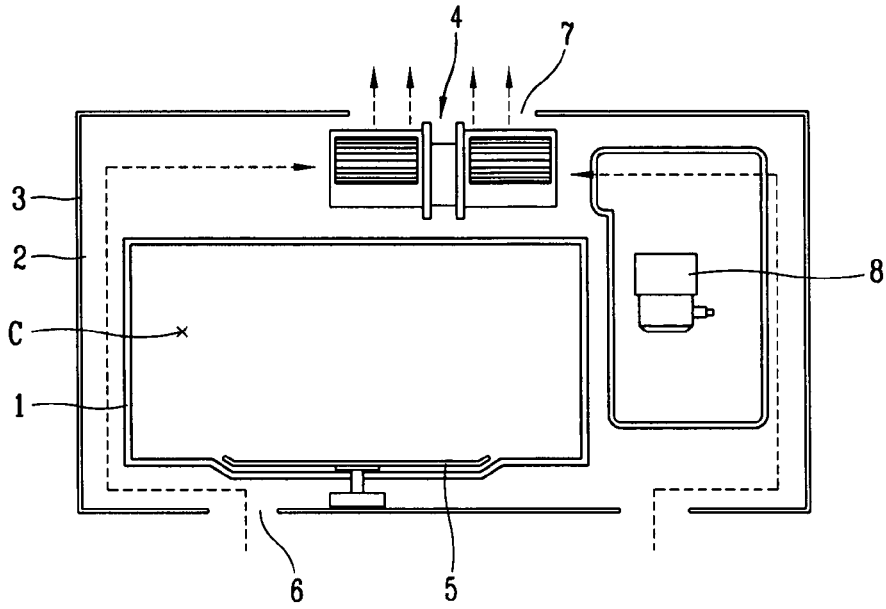
FIG. 1 CONVENTIONAL ART
FIG. 1 is a front view schematically showing a structure of a conventional over-the-range microwave oven having a centrifugal fan.
Figure 2:
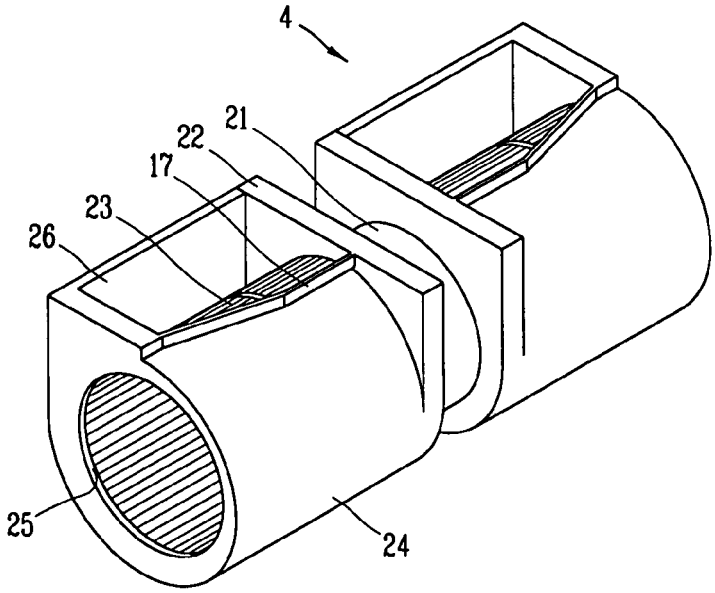
FIG. 2 CONVENTIONAL ART
FIG. 2 is a perspective view showing a conventional blower.
Figure 3:
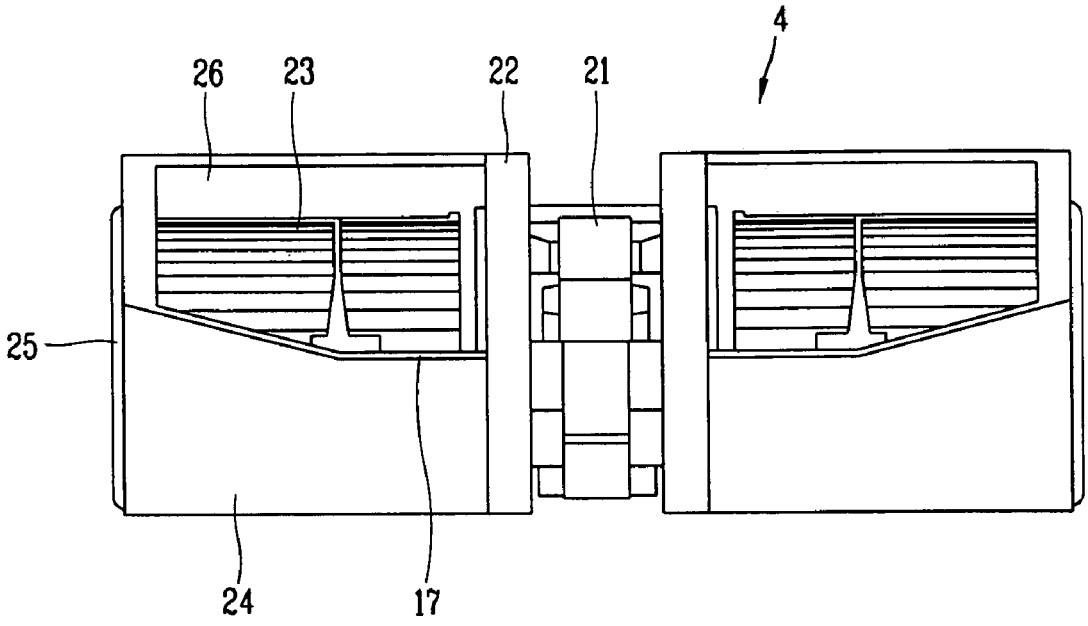
FIG. 3 CONVENTIONAL ART
FIG. 3 is a front view of FIG. 2.
Figure 4:
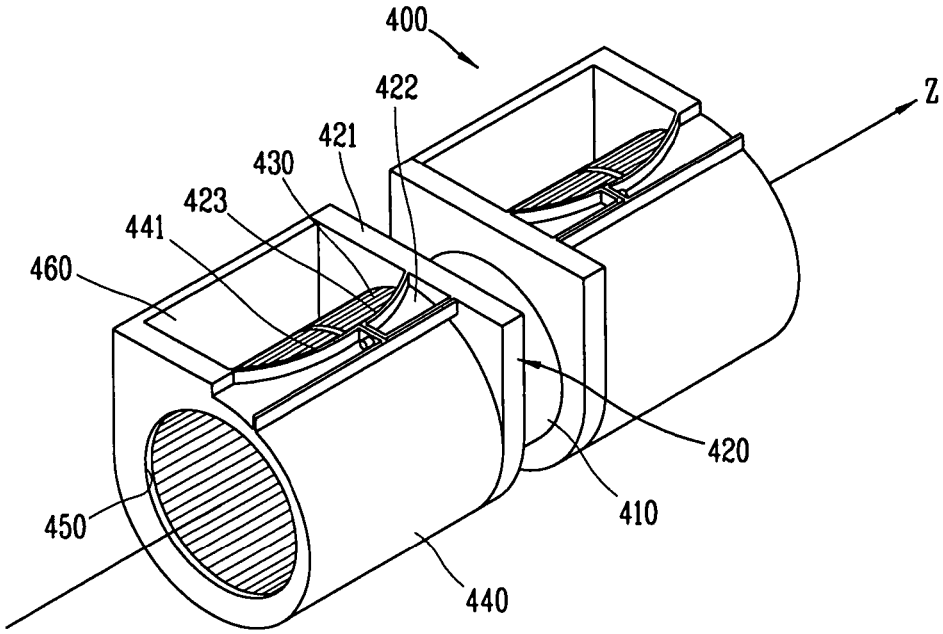
FIG. 4 is a perspective view showing a blower according to a first embodiment of the present invention.
Figure 5:
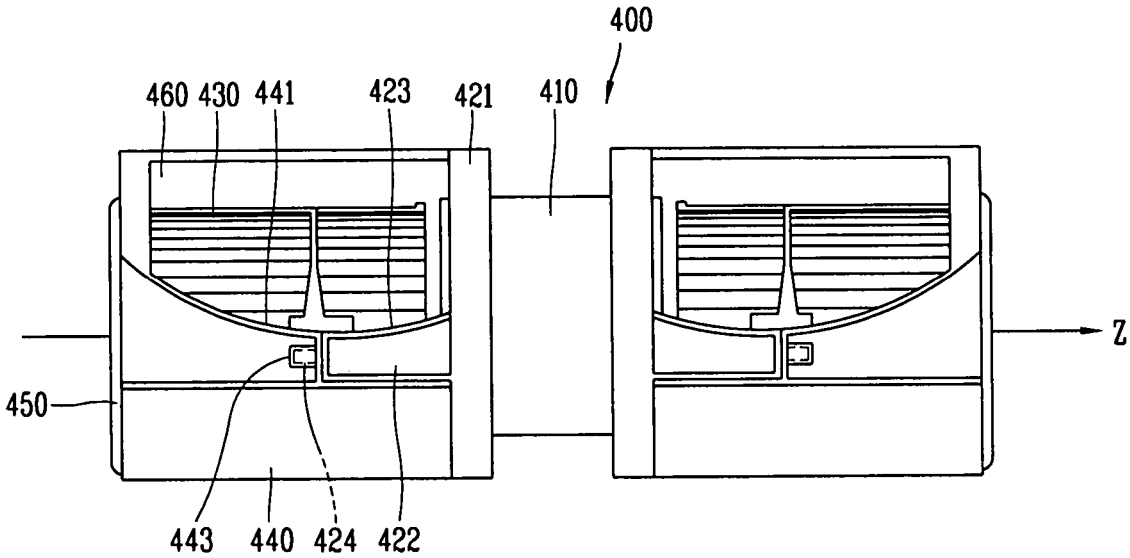
FIG. 5 is a front view of FIG. 4.

FIG. 4 is a perspective view showing a blower according to a first embodiment of the present invention, and FIG. 5 is a front view of the blower shown in FIG. 4.

The blower 400 according to the present invention, as shown in FIG. 4, includes: a centrifugal fan 430; a driving unit 410 having a driving motor (now shown) therein for rotating the centrifugal fan 430; a bracket 420 fixedly-coupled to the driving unit 410; and a fan housing 440 fixedly-coupled to the bracket 420 to thus rotatably receive the centrifugal fan 430 and having a suction port 450 formed at one side of the bracket 420 in a shaft direction (Z direction shown in the drawing) of the centrifugal fan 430 so as to suck air by the rotation of the centrifugal fan 430, and a discharge port 460 formed to be perpendicular to the suction port 450, for discharging the air sucked through the suction port 450.

On the other hand, as shown in the drawings, the present invention illustrates a double suction type blower in which the centrifugal fan 430, the bracket 420, and the fan housing 440 are symmetrically configured on the basis of the driving unit 410.

The bracket 420 includes a base 421 fixedly-coupled to one side of the driving unit 410, and a protrusion 422 protruded outwardly from the base 421 in a shaft direction of the centrifugal fan 430 and of which one end is contact with the fan housing 440.

The protrusion 422 formed at the bracket 420 has a first inclination surface 423 formed long in the shaft direction Z of the centrifugal fan 430 and being a portion of one side of the discharge port 460. In addition, the fan housing 440 being contact with one end of the protrusion 422 has a second inclination surface 441 forming the one side of the discharge port together with the first inclination surface 423 of the protrusion 422.

The one side of the discharge port formed by the first and second inclination surfaces 423 and 441 is formed to be protruded so as to guide air discharged through the discharged port.

Here, such one side of the discharge port 460 is substantially formed in a 'V'-shape by the first inclination surface 423 formed at the protrusion 422 of the bracket 420 to thusly discharge the air smoothly and the second inclination surface 441 formed at the fan housing 440 which is contact with one end of the protrusion 422. At least one of the first inclination surface 423 and the second inclination surface 441 is formed in a curved line so as to increase a discharge area of the discharge port 460.

As shown in FIGS. 4 and 5, the blower according to the first embodiment of the present invention illustrates the first and second inclination surfaces 423 and 441 both of which are formed in a curved line.

Conversely, a fixing unit for coupling the fan housing 440 and the bracket 420 is provided in the protrusion 422 of the bracket 420 and one side of the fan housing 440 being contact with the protrusion 422.

The fixing unit includes a fixing portion 424 protruded from one end part of the protrusion 422 of the bracket 420 which is contact with the fan housing 440 in the shaft direction Z of the centrifugal fan 430, and an insertion portion 443 formed in one end part of the fan housing 440 being contact with the one end part of the protrusion 422 and into which the fixing portion 424 is inserted.

A blower according to second and third embodiments of the present invention will now be explained. Here, the same reference numbers are used for the same structure as the blower according to the first embodiment of the present invention and an overlapped explanation thereof will be omitted.

Figure 6:
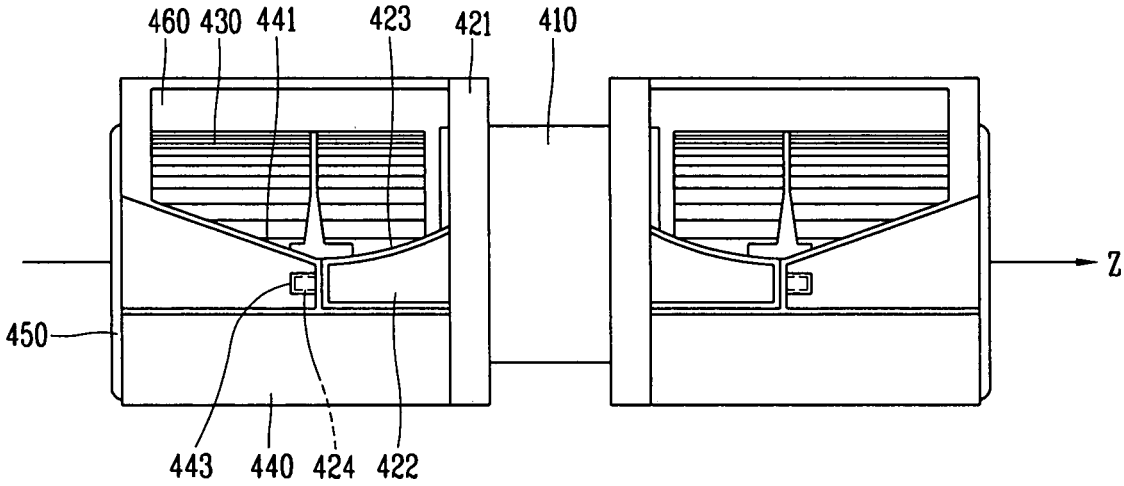
FIG. 6 is a front view showing a blower according to a second embodiment of the present invention.

FIG. 6 shows a blower according to the second embodiment of the present invention. As shown therein, the first inclination surface 423 formed in the protrusion 422 of the bracket 420 is formed in a curved shape, and the second inclination surface 441 of the fan housing 440 which forms the one side of the discharge port together with the first inclination surface 423 is also formed in a curved line.

Figure 7:
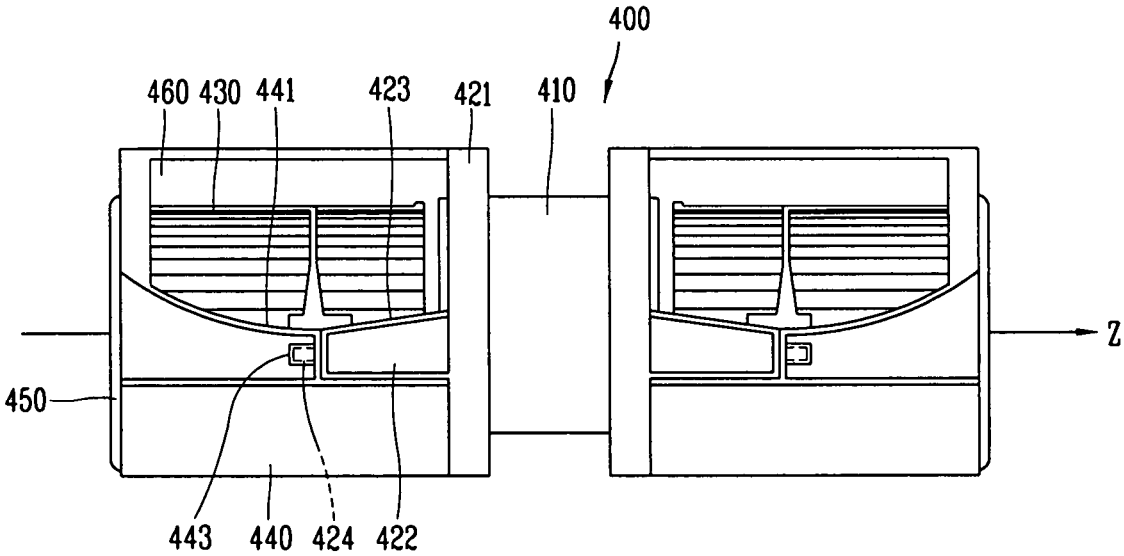
FIG. 7 is a front view showing a blower according to a third embodiment of the present invention.

On the contrary to this, as shown in FIG. 7, in the blower according to the third embodiment of the present invention, the first inclination surface 423 formed in the protrusion of the bracket 420 which forms a part of one side of the discharge port 460 is formed in a straight line, while the second inclination surface 441 of the fan housing 440 forming the one side of the discharge port 422 together with the first inclination surface 423 is formed in a curved line.

A inclination rate of the first and second inclination surfaces 423 and 441 and a radius of curvature of the curved line can variably be configured according to design variables such as the protruded length of the protrusion 422.

An explanation will be provided for a method for designing the first and second inclination surfaces 423 and 41 configuring the one side of the discharge port 460 of the blower 400 as the curved line.

Figure 8:
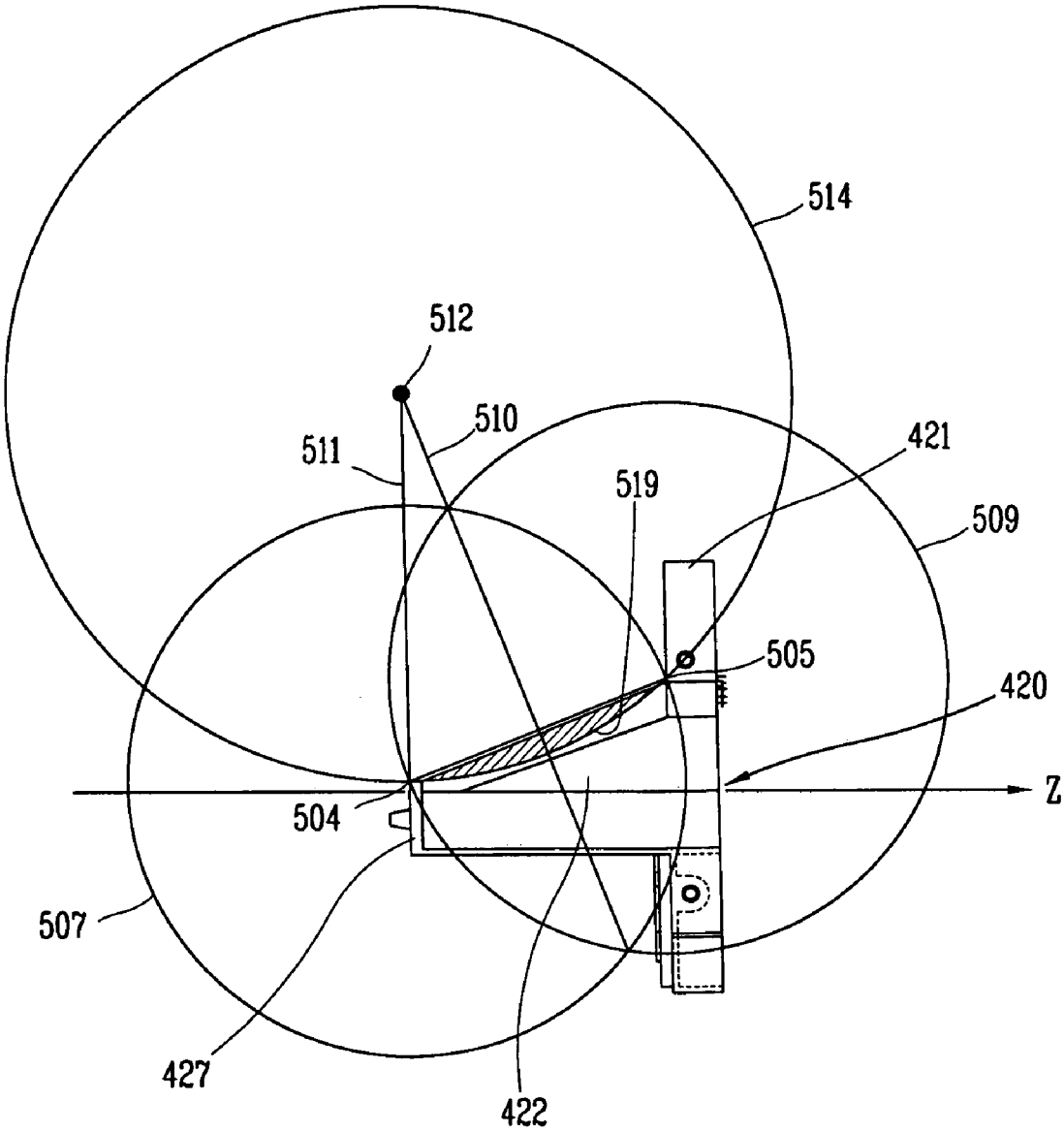
FIG. 8 is a design view showing a design method for a curved line portion of a discharge port of the blower according to the present invention.

FIG. 8 is a design view showing the method for designing the curved line portion of the discharge port according to the present invention. For a detailed embodiment of the design method, a method for designing the first inclination surface formed in the protrusion 422 of the bracket 420 in a curved line will now be explained.

First, a first circle 507 is drawn so as to have a radius corresponding to a distance between a first end point 504 and a second end point 505 positioned on the same plane therewith, among points where a first inclination surface 423 meets a base 421 of a bracket 420 centered upon the first end point 504 of a tangential line of one end 427 of the protrusion 422 of the bracket 420 which is contact with one end of the fan housing 441.

Next, a second circle 509 having a radius corresponding to a distance between the first end point 504 and the second end point 505 centered upon the second end point 505 is drawn.

Afterwards, a process is performed for obtaining a first intersection point 512 where a straight line 510 passing through two intersection points of the first and second circles 507 and 509 meets one of straight lines which pass through the first end point 504 and are perpendicular to the rotary shaft Z of the centrifugal fan 430.

A third circle is then drawn such that the third circle has a radius corresponding to a distance between the first intersection point 512 and the first end point 504 centered upon the first intersection point 512, and thus a curved line 519 passing through the first and second end points 504 and 505 is obtained.

Therefore, as shown in FIG. 8, as the first inclination surface 423 is formed in the curved line, the discharge area of the discharge port 460 of the blower 400 is increased as large as shown in the biased area.

On the other side, the method for designing the second inclination surface 441 of the fan housing 430 as the curved line uses the same sequence and method as the design method for the curved line of the first inclination surface 423 aforementioned, and thus the detailed explanation therefore will be omitted.

As described above, in the blower according to the present invention, the one side of the discharge port thereof is formed by two inclination surfaces, one of which is designed as the curved line so as to increase the discharge area of the discharge port. As a result, a flow rate discharged through the discharge port can uniformly be distributed, which leads to reduction of noise and increase of discharged air volume.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A blower comprising:

a centrifugal fan;

a driving unit for rotating the centrifugal fan;

a bracket including a base fixedly-coupled to one side of the driving unit and a protrusion protruded from the base in a shaft direction of the centrifugal fan; and a fan housing fixedly-coupled to the bracket so as to rotatably receive the centrifugal fan, and including a suction port formed at one side of the bracket in the shaft direction of the centrifugal fan so as to suck air by the rotation of the centrifugal fan, and a discharge port formed in a perpendicular direction of the suction port, for discharging the air sucked through the suction port, wherein one side of the discharge port is formed in 'V' shape by a first inclination surface formed in the protrusion of the bracket and a second inclination surface formed at the fan housing which is contact with one end of the protrusion, and at least one of the first and second inclination surfaces is formed in a circular arc so as to increase a discharge area of the discharge port.

2. The blower of claim 1, wherein the first inclination surface is formed in a circular arc and the circular arc is formed by the steps of;

drawing a first circle having a radius corresponding to a distance between a first end point and a second end point of a protrusion of the bracket, centered upon the first end point;

drawing a second circle having a radius corresponding to a distance between the first end point and the second end point centered upon the second end point;

obtaining an intersection point where a straight line passing through two intersection points of the first and second circles meets a straight line which passes through the first end point and is perpendicular to the rotary shaft of the centrifugal fan; and drawing a third circle having a radius corresponding to a distance between the intersection point and the first end point centered upon the intersection point, thus connecting the first and second end points to each other.

3. The blower of claim 2, wherein the first inclination surface is formed in the curved line and the second inclination surface is formed in a straight line.

4. The blower of claim 1, wherein a fixing unit for coupling the fan housing and the bracket is provided in the protrusion of the bracket and one end of the fan housing.

5. The blower of claim 4, wherein the fixing unit includes a fixing portion protruded from one end part of the protrusion of the bracket which is contact with the fan housing in the shaft direction of the centrifugal fan, and an insertion portion formed in one end part of the fan housing being contact with the one end part of the protrusion and into which the fixing portion is inserted.

6. A blower comprising:

a pair of centrifugal fans;

a driving unit for rotating the centrifugal fans;

a pair of brackets each of which includes a base fixedly-coupled to both sides of the driving unit, respectively, and a protrusion protruded from the base in a shaft direction of the centrifugal fan; and a pair of fan housings fixedly-coupled to the bracket so as to rotatably receive the centrifugal fan, and each of which includes a suction port formed at one side of the bracket in the shaft direction of the centrifugal fan so as to suck air by the rotation of the centrifugal fan, and a discharge port formed in a perpendicular direction of the suction port, for discharging the air sucked through the suction port, wherein one side of the discharge port is formed in 'V' shape by a first inclination surface formed in the protrusion of the bracket and a second inclination surface formed at the fan housing which is contact with one end of the protrusion, and at least one of the first and second inclination surfaces is formed in a circular arc so as to increase a discharge area of the discharge port.

7. The blower of claim 6, wherein the first inclination surface is formed in a circular arc and the circular arc is formed by the steps of:

drawing a first circle having a radius corresponding to a distance between a first end point and a second end point of a protrusion of the bracket, centered upon the first end point;

drawing a second circle having a radius corresponding to a distance between the first end point and the second end point centered upon the second end point;

obtaining an intersection point where a straight line passing through two intersection points of the first and second circles meets a straight line which passes through the first end point and is perpendicular to the rotary shaft of the centrifugal fan; and drawing a third circle having a radius corresponding to a distance between the intersection point and the first end point centered upon the intersection point, thus connecting the first and second end points to each other.

8. The blower of claim 7, wherein the second inclination surface is a circular arc formed in the same manner as the circular arc of the first inclination surface.

9. The blower of claim 6, wherein a fixing unit for coupling the fan housing and the bracket is provided in the protrusion of the bracket and one end of the fan housing.

10. The blower of claim 9, wherein the fixing unit includes a fixing portion protruded from one end part of the protrusion of the bracket which is contact with the fan housing in the shaft direction of the centrifugal fan, and an insertion portion formed in one end pad of the fan housing being contact with the one end part of the protrusion and into which the fixing portion is inserted.

11. The blower of claim 6, wherein the bower is installed in an over-the-range (OTR) microwave oven.

12. A design method for a curved line of a first inclination surface configuring a discharge port of a blower comprising the steps of:

drawing a first circle having a radius corresponding to a distance between a first end point and a second end point positioned on the same plane therewith, among points where a first inclination surface meets a base of a bracket centered upon the first end point of a tangential line of one end of a protrusion of the bracket which is contact with one end of a fan housing having a second inclination surface;

drawing a second circle having a radius corresponding to a distance between the first end point and the second end point centered upon the second end point;

obtaining a first intersection point where a straight line passing through two intersection points of the first and second circles meets one of straight lines which pass through the first end point and are perpendicular to the rotary shaft of the centrifugal fan; and drawing a third circle having a radius corresponding to a distance between the first intersection point and the first end point centered upon the first intersection point, and thus obtaining a curved line passing through the first and second end points.

* * * * *